US011543151B1

(12) United States Patent
Hegeman

(10) Patent No.: US 11,543,151 B1
(45) Date of Patent: Jan. 3, 2023

(54) ROOF VENT COVER SYSTEM

(71) Applicant: Jordan Hegeman, Charlotte, NC (US)

(72) Inventor: Jordan Hegeman, Charlotte, NC (US)

( * ) Notice: Subject to any disclaimer, the term of this patent is extended or adjusted under 35 U.S.C. 154(b) by 86 days.

(21) Appl. No.: 17/234,877

(22) Filed: Apr. 20, 2021

(51) Int. Cl.

| | |
|---|---|
| ***F24F 13/20*** | (2006.01) |
| ***F24F 7/02*** | (2006.01) |
| ***E03C 1/126*** | (2006.01) |
| ***E04D 13/147*** | (2006.01) |

(52) U.S. Cl.
CPC ..... *F24F 13/20* (2013.01); *E03C 1/126* (2013.01); *E04D 13/1476* (2013.01); *F24F 7/02* (2013.01)

(58) Field of Classification Search
CPC ..... F24F 13/20; F24F 7/02; F24F 2221/16; E03C 1/126; E04D 13/1476
USPC ..... 454/367
See application file for complete search history.

(56) References Cited

U.S. PATENT DOCUMENTS

| | | | | |
|---|---|---|---|---|
| 3,797,181 | A * | 3/1974 | Nievelt | E04F 17/04 285/43 |
| 4,652,321 | A | 3/1987 | Greko | |
| 6,244,006 | B1 * | 6/2001 | Shue | F24F 7/02 52/302.1 |
| 8,272,186 | B2 | 9/2012 | Manning | |
| 8,484,914 | B2 * | 7/2013 | Cline | E04D 13/1407 52/219 |
| 9,328,514 | B1 | 5/2016 | Thompson | |
| D796,074 | S | 8/2017 | Bond | |
| 2006/0211356 | A1 | 9/2006 | Grassman | |
| 2007/0101664 | A1 * | 5/2007 | Hoy | E04D 13/1407 52/198 |
| 2011/0275307 | A1 * | 11/2011 | McIver | F24F 7/02 454/367 |

FOREIGN PATENT DOCUMENTS

| | | |
|---|---|---|
| CA | 1268657 | 5/1990 |

* cited by examiner

*Primary Examiner* — Avinash A Savani
*Assistant Examiner* — Ryan L Faulkner
(74) *Attorney, Agent, or Firm* — Kyle A. Fletcher, Esq.

(57) ABSTRACT

The roof cover vent system comprises a vent sheath, a flange sheath, and a pitched roof. The pitched roof further comprises a roof vent and a roof pitch. The vent sheath attaches to the flange sheath to form a composite prism structure. The roof vent inserts into the composite prism structure formed by the vent sheath and the flange sheath. The composite prism structure formed by the vent sheath and the flange sheath enclose the lateral face and the inferior structures of the roof vent while allowing the roof vent to release gas into the atmosphere. The flange sheath is formed as a prismatic section. The prismatic section is selected such that center axis of the composite prism structure formed by the vent sheath and the flange sheath will remain parallel to the force of gravity while the flange sheath rests flush on the pitched roof.

16 Claims, 11 Drawing Sheets

ROOF VENT COVER SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of buildings and roof, more specifically, a junction for a roof sheathing (for a vent extending above the roof) that is specially adapted for inclined roofs. (E04D13/147)

SUMMARY OF INVENTION

The roof cover vent system comprises a vent sheath, a flange sheath, and a pitched roof. The pitched roof is defined elsewhere in this disclosure. The pitched roof further comprises a roof vent and a roof pitch. The roof vent is a structure that allows gases contained within a structure to flow through the pitched roof. The roof pitch refers to the angle formed between the force of gravity and the superior surface of the pitched roof. The vent sheath attaches to the flange sheath to form a composite prism structure. The roof vent inserts into the composite prism structure formed by the vent sheath and the flange sheath. The composite prism structure formed by the vent sheath and the flange sheath enclose the lateral face and the inferior structures of the roof vent while allowing the roof vent to release gas into the atmosphere. The flange sheath is formed as a prismatic section. The prismatic section is selected such that center axis of the composite prism structure formed by the vent sheath and the flange sheath will remain parallel to the force of gravity while the flange sheath rests flush on the pitched roof.

These together with additional objects, features and advantages of the roof cover vent system will be readily apparent to those of ordinary skill in the art upon reading the following detailed description of the presently preferred, but nonetheless illustrative, embodiments when taken in conjunction with the accompanying drawings.

In this respect, before explaining the current embodiments of the roof cover vent system in detail, it is to be understood that the roof cover vent system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the roof cover vent system.

It is therefore important that the claims be regarded as including such equivalent construction insofar as they do not depart from the spirit and scope of the roof cover vent system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
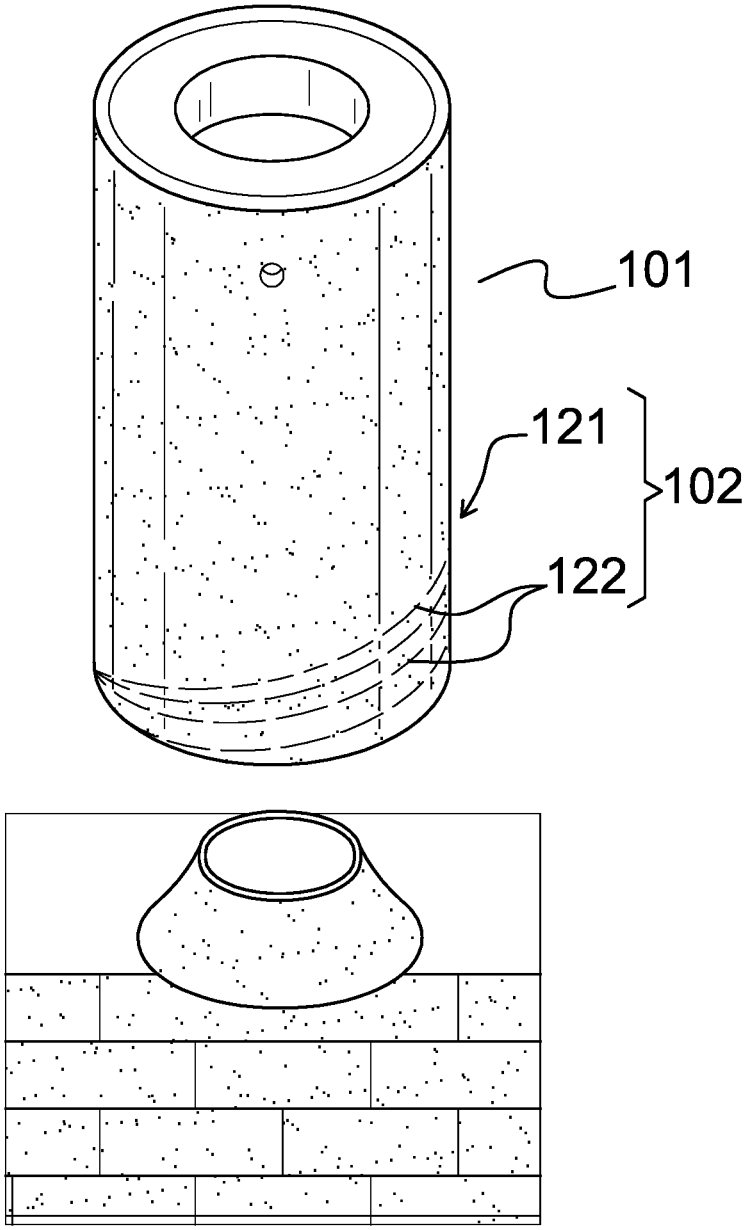
FIG. 1 is a perspective view of an embodiment of the disclosure.
Figure 2:
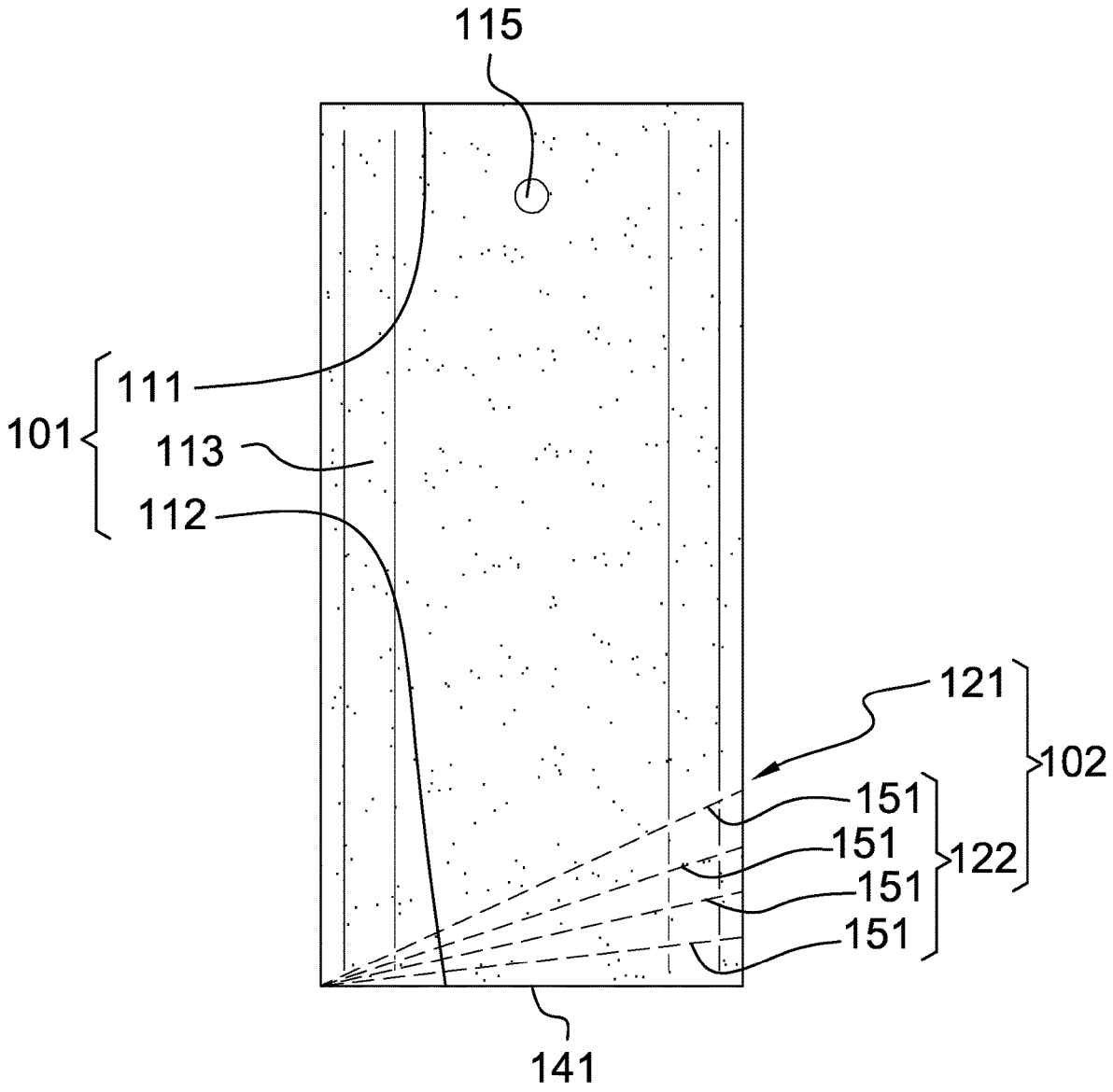
FIG. 2 is a side view of an embodiment of the disclosure.
Figure 3:
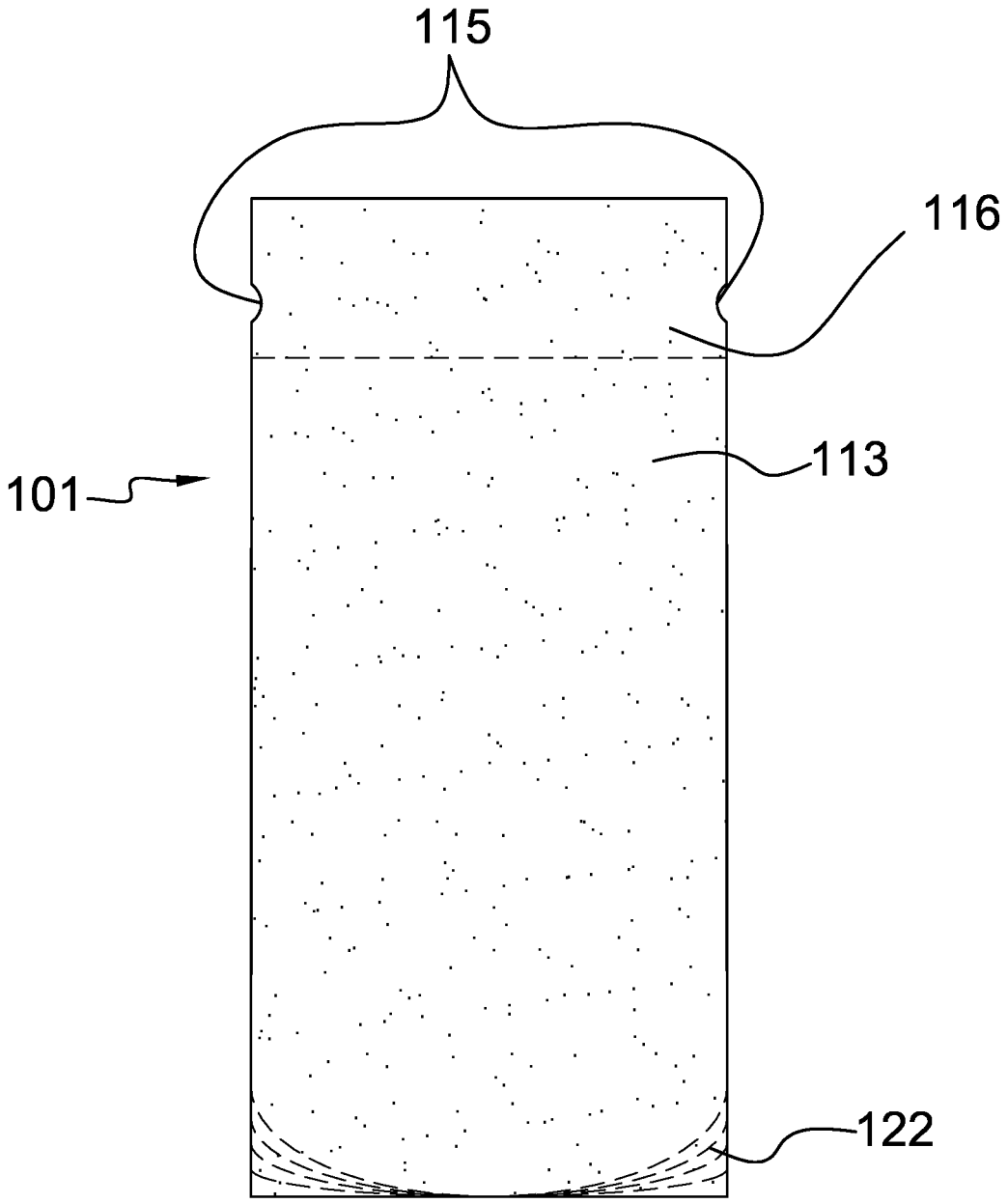
FIG. 3 is a front view of an embodiment of the disclosure.
Figure 4:
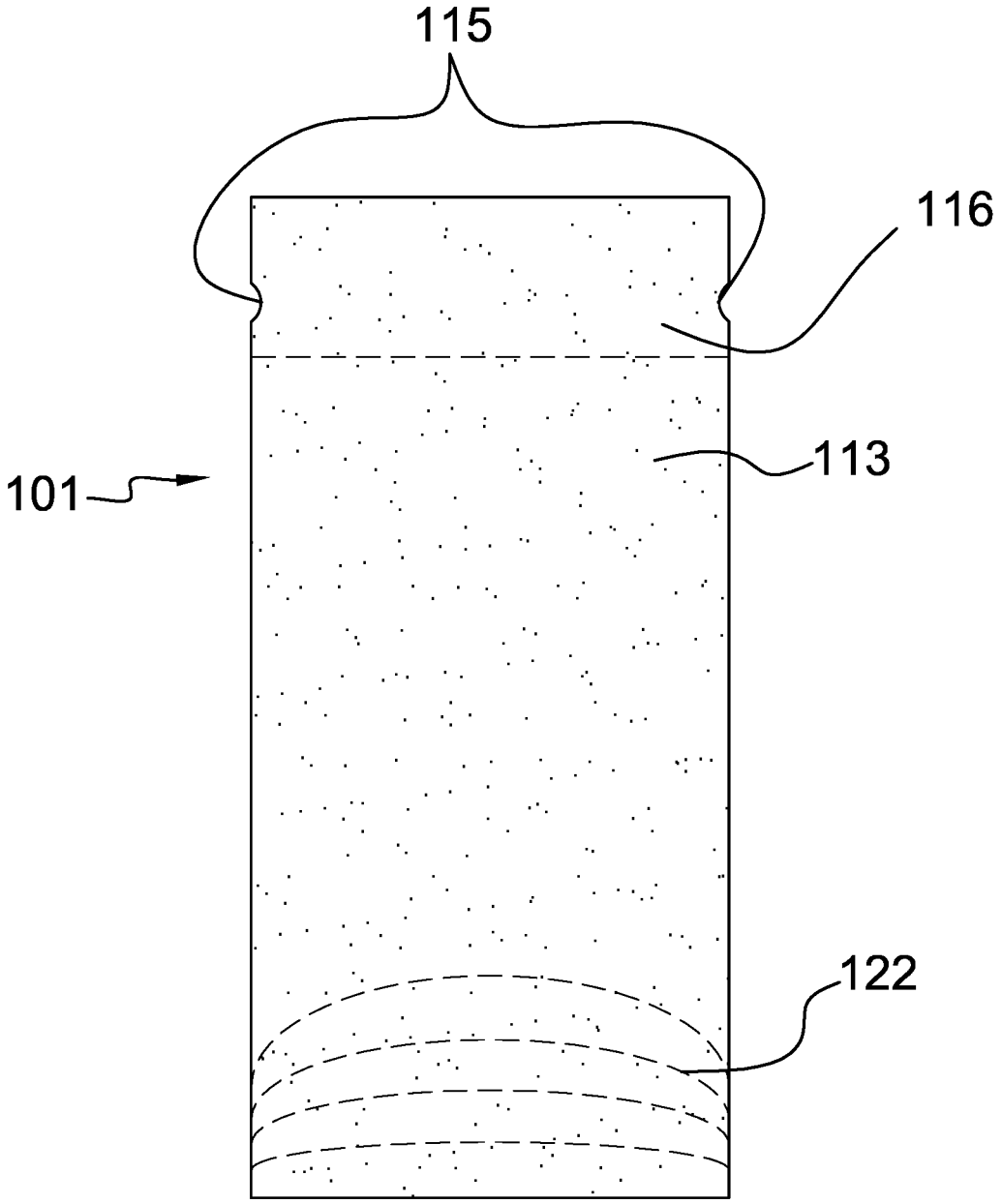
FIG. 4 is a rear view of an embodiment of the disclosure.
Figure 5:
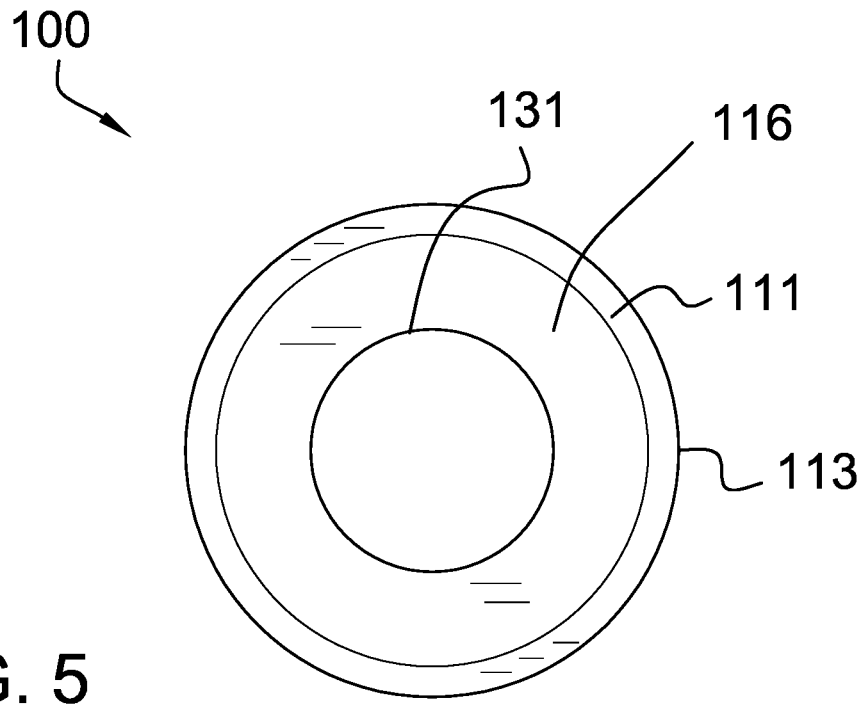
FIG. 5 is a top view of an embodiment of the disclosure.
Figure 6:
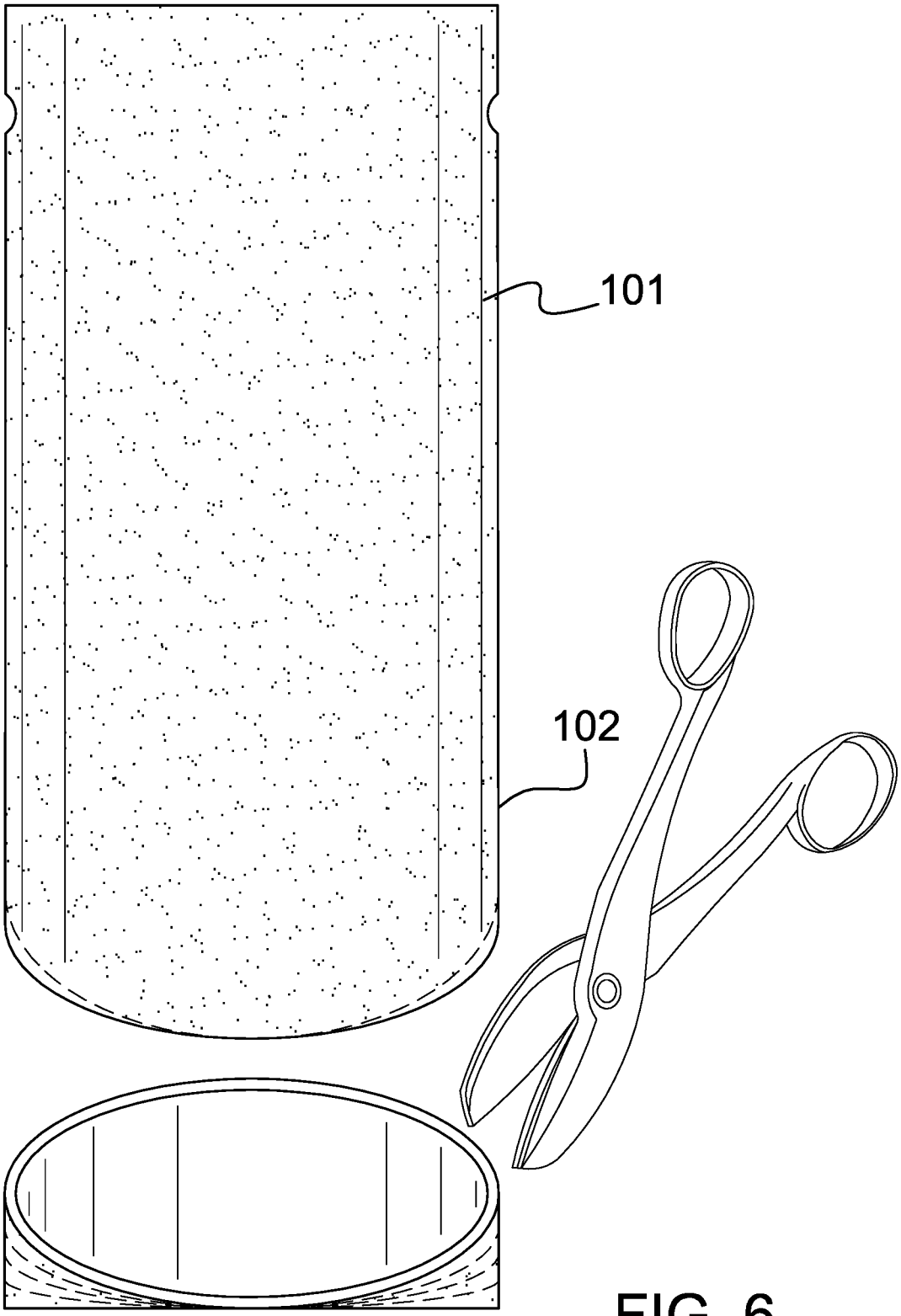
FIG. 6 is a bottom view of an embodiment of the disclosure.
Figure 7:
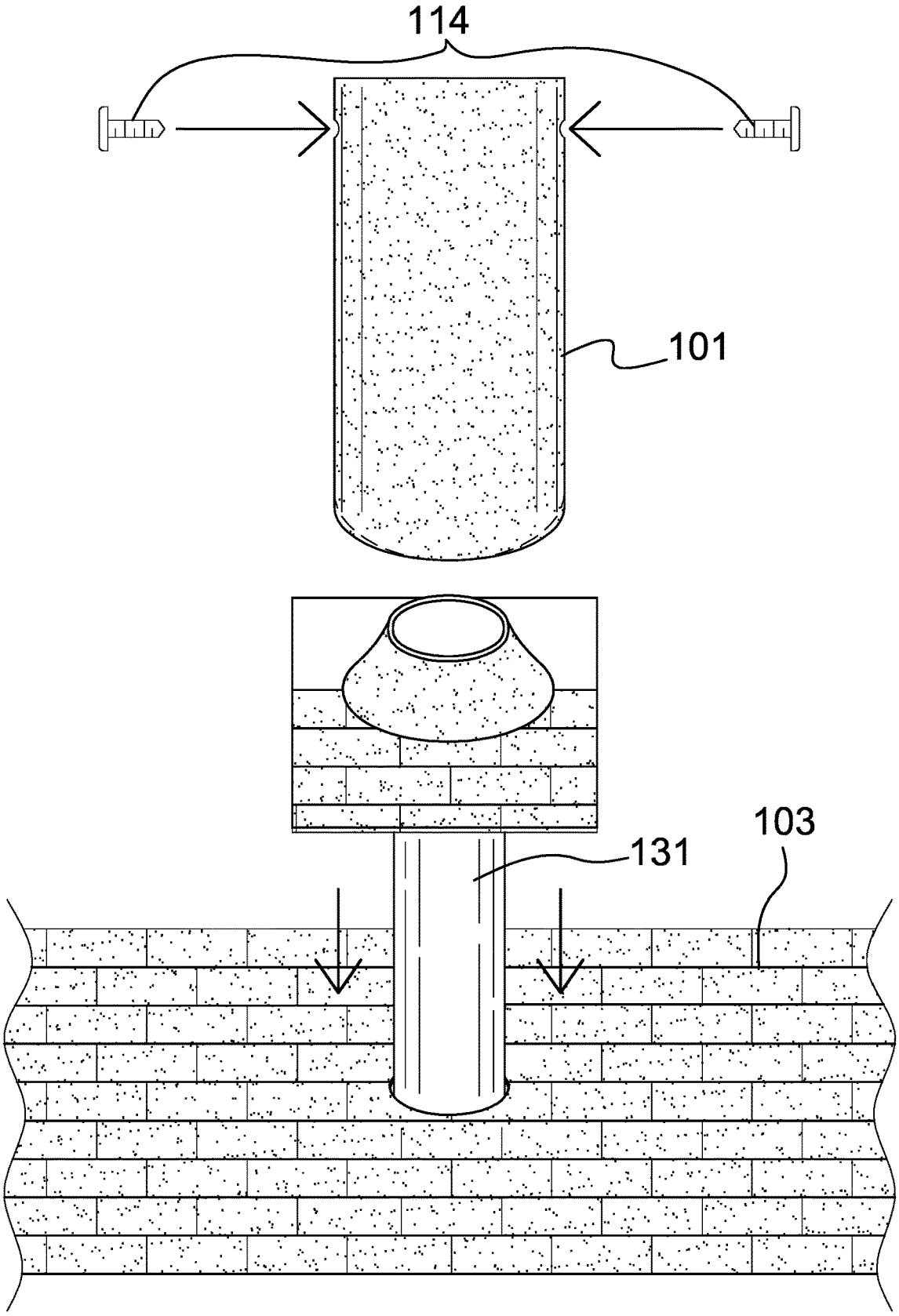
FIG. 7 is an in-use view of an embodiment of the disclosure.
Figure 8A:
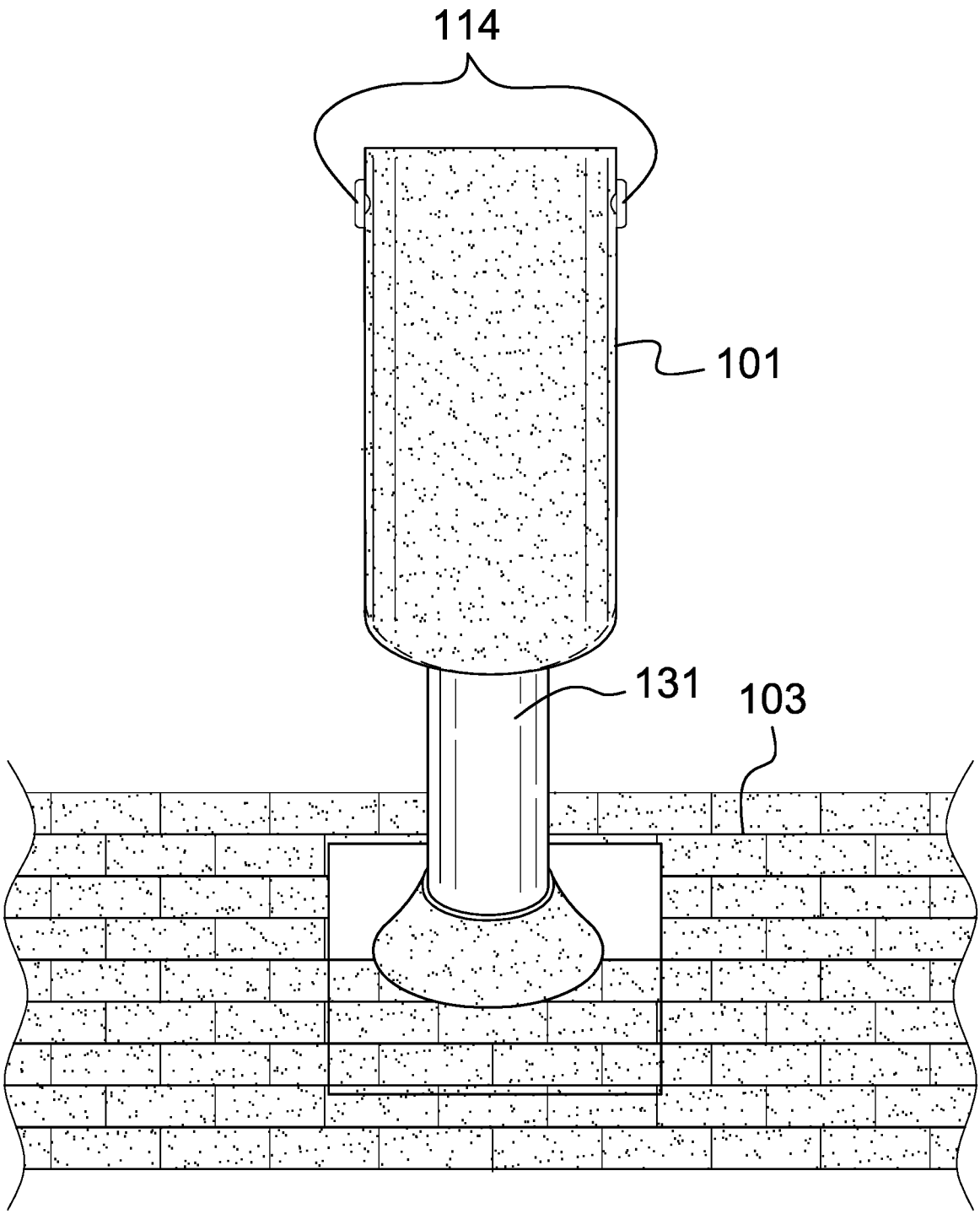
FIG. 8A is an in-use view of an embodiment of the disclosure.
Figure 8B:
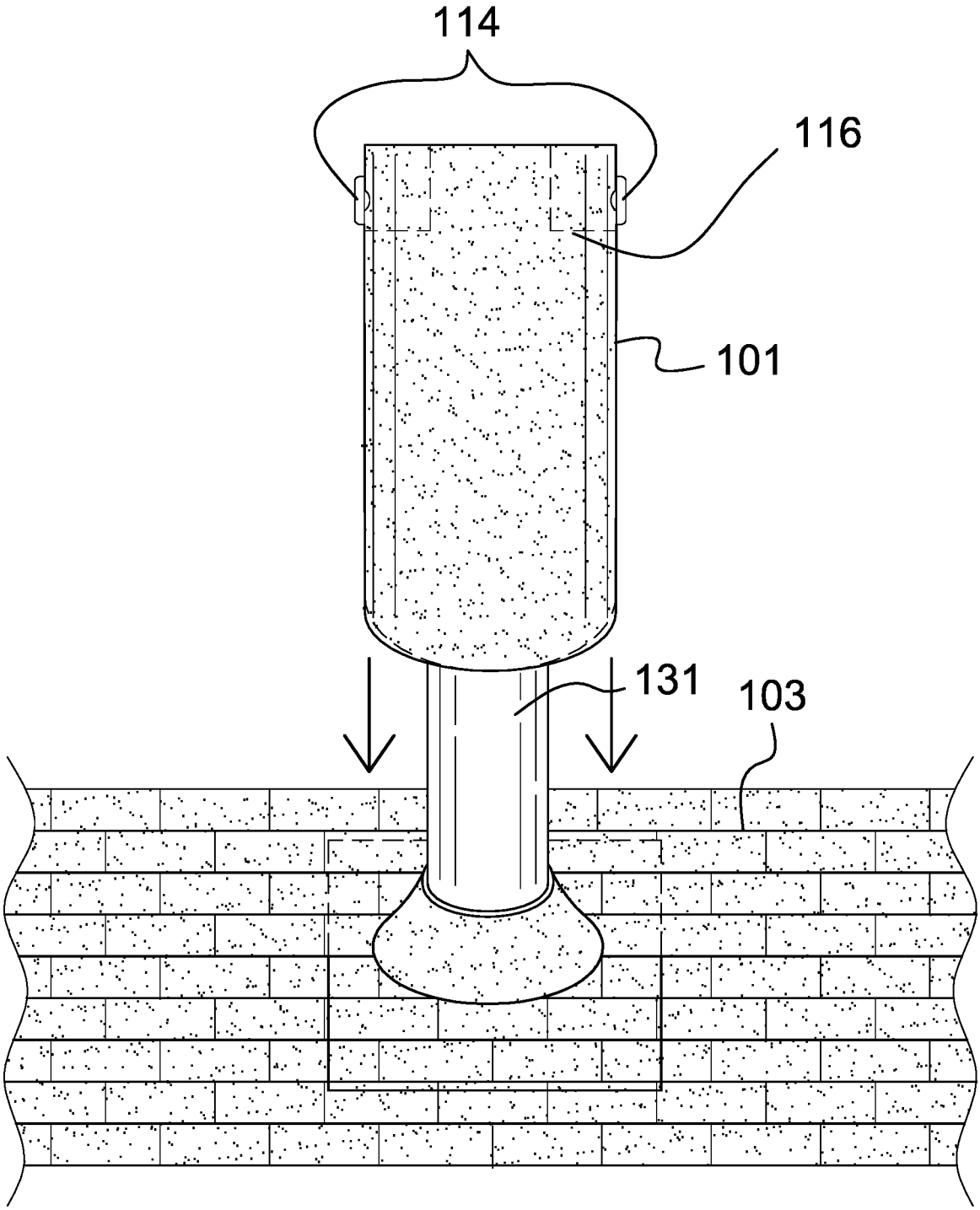
FIG. 8B is an in-use view of an embodiment of the disclosure.
Figure 9:
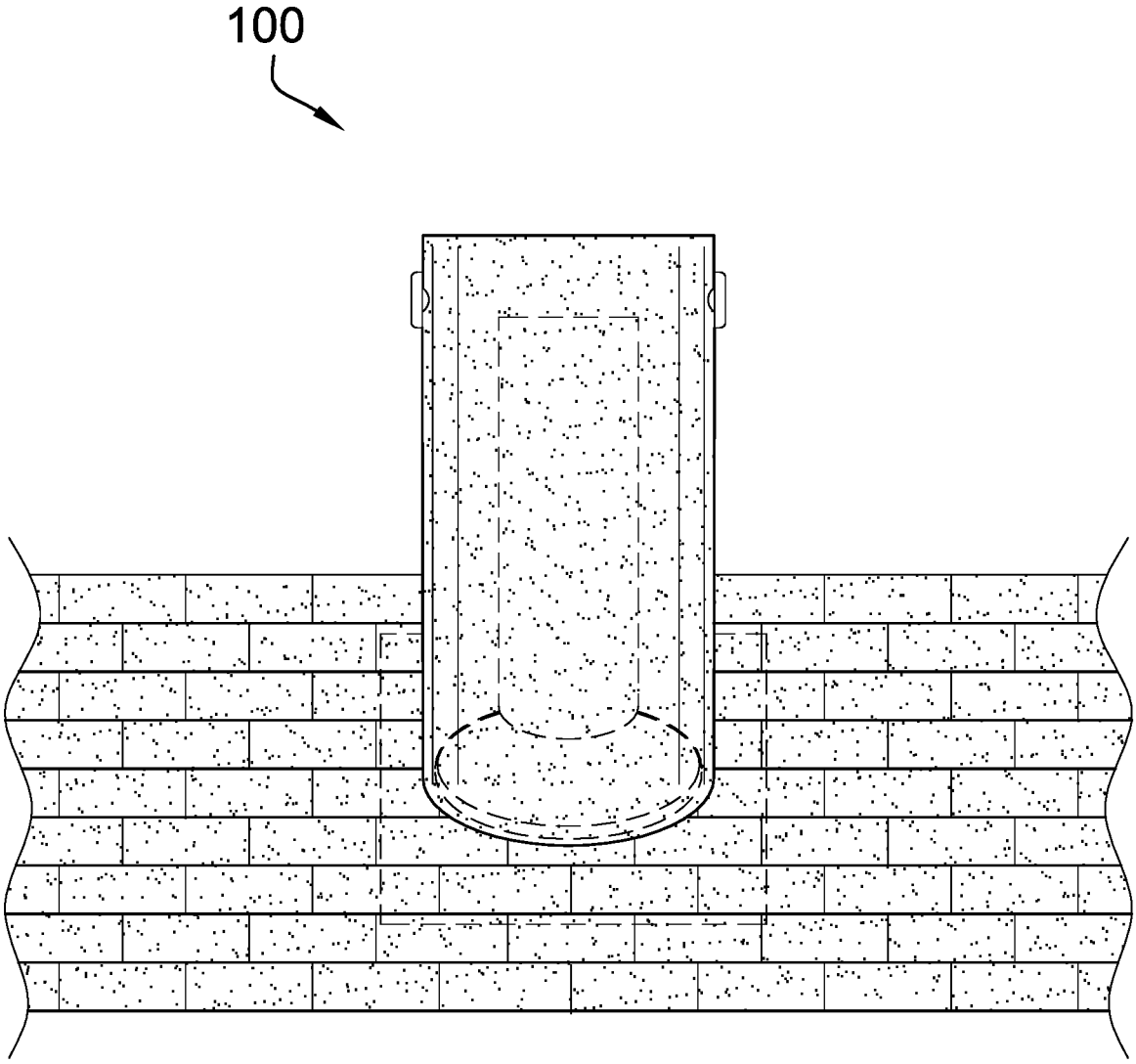
FIG. 9 is an in-use view of an embodiment of the disclosure.
Figure 10:
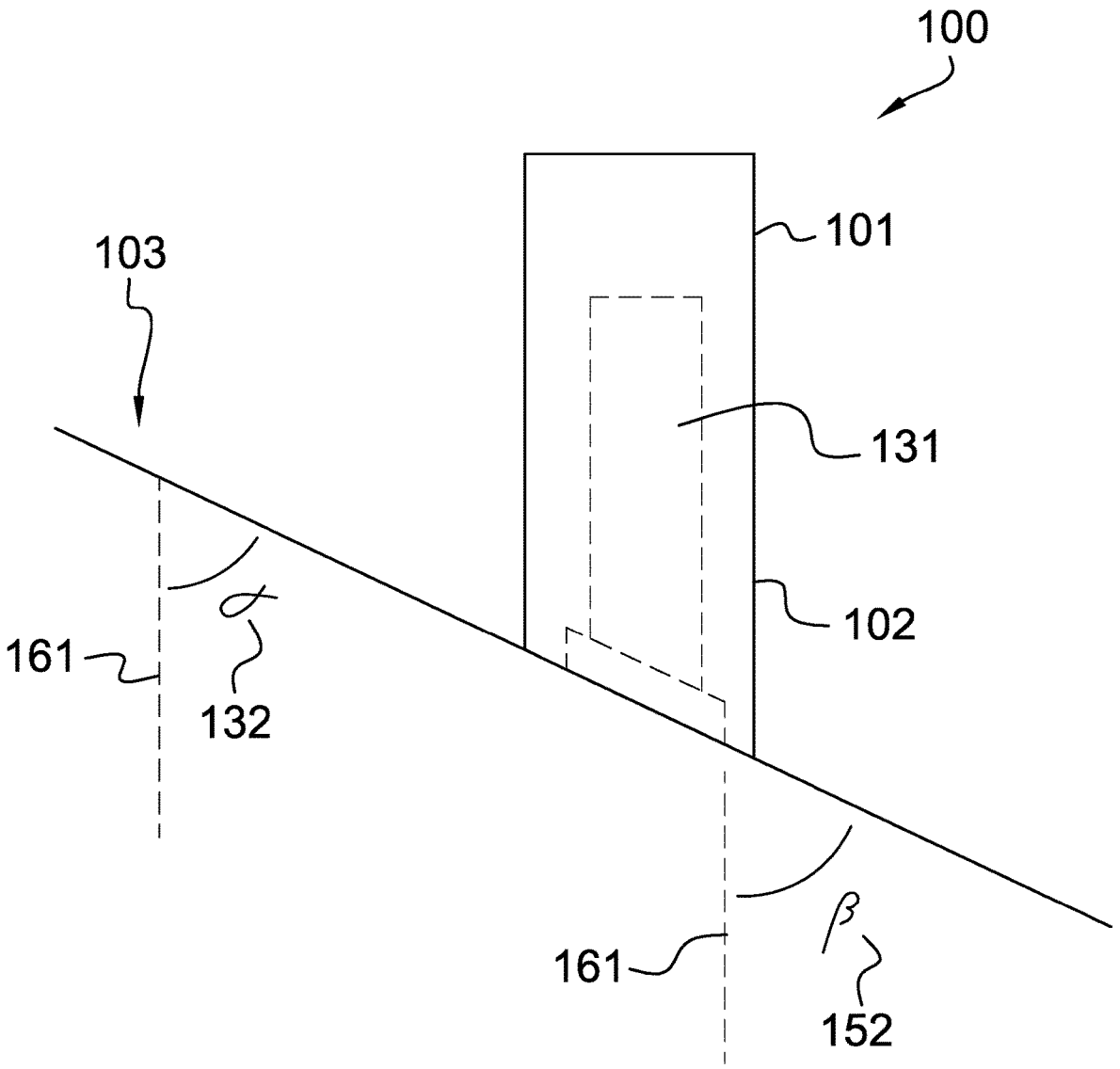
FIG. 10 is an in-use view of an embodiment of the disclosure.

Detailed reference will now be made to one or more potential embodiments of the disclosure, which are illustrated in FIGS. 1 through 10.

The roof cover vent system 100 (hereinafter invention) comprises a vent sheath 101, a flange sheath 102, and a pitched roof 103. The pitched roof 103 further comprises a roof vent 131 and a roof pitch 132. The roof vent 131 is a structure that allows gases contained within a structure to flow through the pitched roof 103. The roof pitch 132 refers to the angle formed between the force of gravity 161 and the superior surface of the pitched roof 103. The vent sheath 101 attaches to the flange sheath 102 to form a composite prism structure. The roof vent 131 inserts into the composite prism structure formed by the vent sheath 101 and the flange sheath 102. The composite prism structure formed by the vent sheath 101 and the flange sheath 102 enclose the lateral face and the inferior structures of the roof vent 131 while allowing the roof vent 131 to release gas into the atmosphere. The flange sheath 102 is formed as a prismatic section. The prismatic section is selected such that the center axis of the composite prism structure formed by the vent sheath 101 and the flange sheath 102 will remain parallel to the force of gravity 161 while the flange sheath 102 rests flush on the pitched roof 103.

The pitched roof 103 is defined elsewhere in this disclosure. The center axis of the prism structure of the roof vent 131 aligns with the force of gravity 161. The roof vent 131 is defined elsewhere in this disclosure. The roof pitch 132 is defined elsewhere in this disclosure.

The vent sheath 101 is a prism-shaped structure. The vent sheath 101 is a hollow structure. The vent sheath 101 is formed as a tube. The vent sheath 101 is geometrically similar to the roof vent 131. The span of the length of the inner diameter of the vent sheath 101 is greater than the span of the length of the outer diameter of the roof vent 131 such that the roof vent 131 inserts into the vent sheath 101. The roof vent 131 inserts into the vent sheath 101 in the manner of a composite prism structure. The vent sheath 101 comprises a free congruent end 111, a fixed congruent end 112, a vent lateral face 113, and a plurality of set screws 114.

The free congruent end 111 is a congruent end of the prism structure of the vent sheath 101. The free congruent end 111 is an open end of the tubular structure of the vent sheath 101. The free congruent end 111 is the end of the vent sheath 101 that is distal from the flange sheath 102. The free congruent end 111 of the vent sheath 101 allows gas to vent from the roof vent 131 into the atmosphere.

The fixed congruent end 112 is a congruent end of the prism structure of the vent sheath 101. The fixed congruent end 112 is an open end of the tubular structure of the vent sheath 101. The fixed congruent end 112 is the congruent end of the vent sheath 101 that is distal from the free congruent end 111. The fixed congruent end 112 is the end of the vent sheath 101 that attaches to the flange sheath 102 to form the composite prism structure formed by the vent sheath 101 and the flange sheath 102.

The vent lateral face 113 is the lateral face of the prism structure of the vent sheath 101. The vent lateral face 113 forms the vertically oriented containment that encloses the roof vent 131.

Each of the plurality of set screws 114 is a set screw. Each of the plurality of set screws 114 screws through the vent lateral face 113 and into the roof vent 131 to secure the composite prism structure formed by the vent sheath 101 and the flange sheath 102 to the roof vent 131.

The vent lateral face 113 further comprises a plurality of set screw 114 apertures 115. Each of the plurality of set screw 114 apertures 115 is an aperture formed through the vent lateral face 113 of the vent sheath 101. Each of the plurality of set screw 114 apertures 115 is sized to receive a set screw selected from the plurality of set screws 114.

The vent sheath 101 further comprises a vent seal 116. The vent seal 116 is a mechanical structure that attaches to both the exterior surface of the lateral face of the roof vent 131 and the interior surface of the vent lateral face 113 of the vent sheath 101. The vent seal 116 forms a fluid impermeable seal with the interior surface of the vent lateral face 113. The vent seal 116 forms a fluid impermeable seal with the exterior surface of the lateral face of the roof vent 131. The vent seal 116 is positioned at the free congruent end 111 of the vent sheath 101 such that rain water does not accumulate in the interior space between the vent sheath 101 and the roof vent 131.

The flange sheath 102 is a roughly prism-shaped structure. The flange sheath 102 is a hollow structure. The flange sheath 102 has a roughly pan shape. The flange sheath 102 attaches to the vent sheath 101 to form a composite prism structure. The flange sheath 102 forms the inferior structure of the composite prism structure formed by the vent sheath 101 and the flange sheath 102. The roof vent 131 inserts through the pan shape of the flange sheath 102 into the vent sheath 101. The center axis of the prism structure of the roof vent 131 aligns with the center axes of the flange sheath 102 and the vent sheath 101. The composite prism structure formed by the flange sheath 102 and the vent sheath 101 protects the roof vent 131 and its associated junctions with the pitched roof 103 from weather damage. The flange sheath 102 comprises a pedestal pan 121 and a plurality of perforations 122.

The pedestal pan 121 is a roughly prism-shaped structure. The pedestal pan 121 has a pan shape. The pedestal pan 121 physically forms the inferior structure of the composite prism structure formed by the vent sheath 101 and the flange sheath 102. The pedestal pan 121 forms a portion of the containment structure that encloses the roof vent 131. The pedestal pan 121 comprises an open congruent end 141, a closed congruent end 142, and a flange lateral face 143.

The flange lateral face 143 is the lateral face of the pan structure of the pedestal pan 121.

The open congruent end 141 is a congruent end of the prism structure of the pedestal pan 121. The open congruent end 141 forms the congruent end of the pedestal pan 121 that is distal from the vent sheath 101. The open congruent end 141 rests on the surface of the pitched roof 103.

The closed congruent end 142 is the congruent end of the pan structure of the pedestal pan 121 that forms the closed face. The closed congruent end 142 is the congruent end of the pedestal pan 121 that attaches to the fixed congruent end 112 of the vent sheath 101 to form the composite prism structure formed by the vent sheath 101 and the flange sheath 102. The closed congruent end 142 is formed as a funnel structure 144. The closed congruent end 142 comprises a funnel structure 144.

The funnel structure 144 is a hollow truncated pyramid structure. The roughly prism structure of the flange sheath 102 is formed by the funnel structure 144 that forms the closed congruent end 142 of the flange sheath 102. The fixed congruent end 112 of the vent sheath 101 attaches to the open truncated apex formed by the funnel structure 144. The funnel structure 144 aligns with the center axes of the composite prism structure formed by the vent sheath 101 and the flange sheath 102.

Each of the plurality of perforations 122 is a perforation that is formed in the flange lateral face 143 of the pedestal pan 121. Each of the plurality of perforations 122 is formed to facilitate the removal of a portion of the flange lateral face 143 of the pedestal pan 121 during the installation of the composite prism structure formed by the vent sheath 101 and the flange sheath 102 over the roof vent 131.

Each of the plurality of perforations 122 forms a helix structure on the flange lateral face 143 of the pedestal pan 121. Each of the plurality of perforations 122 forms a cant relative to a plane that perpendicularly intersects the center axis of the prism structure of the pedestal pan 121. Each of the plurality of perforations 122 guides the removal of a portion of the flange lateral face 143 of the pedestal pan 121 such that the pedestal pan 121 is converted into a prismatic section before the composite prism structure formed by the vent sheath 101 and the flange sheath 102 installs over the roof vent 131. The open congruent end 141 of the prism structure of the pedestal pan 121 forms the congruent end that is bifurcated to form the prismatic section structure of the flange sheath 102 that is installed over the roof vent 131.

The plurality of perforations 122 comprises a collection of individual perforations 151. Each individual perforation 151 is a perforation selected from the plurality of perforations 122. Each individual perforation 151 forms a helix on the flange lateral face 143 of the pedestal pan 121. Each individual perforation 151 facilitates the removal of a portion of the flange lateral face 143 of the pedestal pan 121 to form the prismatic structure of the flange sheath 102. Each individual perforation 151 selected from the plurality of perforations 122 is formed with an individual perforation 151 cant 152.

The individual perforation 151 cant 152 of each individual perforation 151 forms a cant with a plane that passes perpendicularly through the center axis of the prism structure of the pedestal pan 121. The individual perforation 151 cant 152 of any first individual perforation 151 selected from the plurality of perforations 122 differs from the individual perforation 151 cant 152 of any second individual perforation 151 selected from the plurality of perforations 122. The individual perforation 151 cant 152 of the individual perforation 151 selected from the plurality of perforations 122 to guide the removal of the flange lateral face 143 is selected to align the open congruent end 141 of the pedestal pan 121 with the roof pitch 132 such that the center axis of the composite prism structure formed by the vent sheath 101 and the flange sheath 102 will align with the force of gravity 161 and the center axis of the roof vent 131.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fixed End: As used in this disclosure, a fixed end refers to the end of a shaft, pipe, or tube that is secured to an object.

Flexible: As used in this disclosure, flexible refers to an object or material that will deform when a force is applied to it but that will not necessarily return to its original shape when the deforming force is removed.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Free End: As used in this disclosure, a free end refers to the end of a disk, shaft, pipe, or tube that is not secured to an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute. The helix has a right handed and left handed orientation. When viewed along the center axis of the helix, if the helix structure moves away from the observer along the clockwise direction, the helix is considered a right handed helix. If the helix structure moves towards the observer along the clockwise direction, the helix is considered a left handed helix. The handedness of the helix does not depend on the end of the helix being viewed.

The helix is mathematically defined by the parametric equation set: x(t)=cos (t), y(t)=sin(t), and z=t.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Pedestal: As used in this disclosure, a pedestal is an intermediary load bearing structure that forms a load path between a supporting surface and an object, structure, or load.

Perforation: A used in this disclosure, a perforation refers to a series of small holes that are formed in a material in such a way as to allow a portion of the material to be easily torn off. The material that contains the perforations is referred to as the perforated material.

Perimeter: As used in this disclosure, a perimeter is one or more curved or straight lines that bounds an enclosed area on a plane or surface. The perimeter of a circle is commonly referred to as a circumference.

Pitched Roof: As used in this disclosure; a pitched roof refers to a roof wherein the surface of the roof forms a cant that is not perpendicular to the force of gravity.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Prismatic Section: As used in this disclosure, a prismatic section refers either one of the two objects formed by the bifurcation of a prism or pyramid by a plane that: 1) passes through the center axis of the prism or pyramid; and 2) does not perpendicularly intersect the center axis of the prism or pyramid. The angle of the prismatic section is the angle formed between the bifurcating plane and a line that is perpendicular to the center axis of the prism. A non-Euclidean prismatic section refers to a prismatic section that is bifurcated by a non-Euclidean plane.

Pyramid: As used in this disclosure, a pyramid is a three-dimensional shape that comprises a base formed in the shape of an N-gon (wherein N is an integer) with N triangular faces that rise from the base to converge at a point above the base. The center axis of a pyramid is the line drawn from the vertex where the N faces meet to the center of the N-gon base. The center axis of a right pyramid is perpendicular to the N-gon base. Pyramids can be further formed with circular or elliptical bases which are commonly referred to as a cone or an elliptical pyramid respectively. A pyramid is defined with a base, an apex, and a lateral face. The base is the N-gon shaped base described above. The apex is the vertex that defines the center axis. The lateral face is formed from the N triangular faces described above.

Roof: As used in this disclosure, a roof is the exterior surface of a structure that is distal from the surface upon which the structure is placed. As used in this disclosure, the exterior surface is assumed to include the supporting structures associated with the exterior surface including, but not limited to, rafters, decking, soffits and fascia. A pitched roof is a roof wherein the surface of the roof has a cant that is not perpendicular to the direction of gravity.

Roughly: As used in this disclosure, roughly refers to a comparison between two objects. Roughly means that the difference between one or more parameters of the two compared objects are not significantly different.

Seal: As used in this disclosure, a seal is a fastening structure that fastens an object into closed position. The term seal is often taken to mean that objects are fastened with a fluid impermeable bond.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Truncated: As used in this disclosure, a geometric object is truncated when an apex, vertex, or end is cut off by a line or plane.

Truncated Pyramid: As used in this disclosure, a truncated pyramid is a frustum that remains when the apex of a pyramid is truncated by a plane that is parallel to the base of the pyramid.

Tube: As used in this disclosure, the term tube is used to describe a rigid hollow prism-shaped device with two congruent open ends. While tubes that are suitable for use in this disclosure are often used to transport or conveys fluids or gases, the purpose of the tubes in this disclosure are structural. In this disclosure, the terms inner dimension and outer dimension of a tube are used as they would be used by those skilled in the plumbing arts.

Vent: As used in this disclosure, a vent is an opening in a structure that allows for the flow of gas through the boundary of the structure.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A protective cover comprising
a vent sheath, a flange sheath, and a pitched roof;
wherein the pitched roof further comprises a roof vent and a roof pitch;
wherein the vent sheath attaches to the flange sheath to form a composite structure;
wherein the roof vent inserts into the composite structure formed by the vent sheath and the flange sheath;
wherein the vent sheath comprises a free congruent end, a fixed congruent end, a vent lateral face, and a plurality of set screws;
wherein the flange sheath comprises a pedestal pan and a plurality of perforations;
wherein the plurality of perforations are formed in the pedestal pan.

2. The protective cover according to claim 1
wherein the composite structure formed by the vent sheath and the flange sheath enclose the lateral face and the inferior structures of the roof vent while allowing the roof vent to release gas into the atmosphere;
wherein the flange sheath is formed as a prismatic section;
wherein the prismatic section is selected such that the center axis of the composite structure formed by the vent sheath and the flange sheath will remain parallel to the force of gravity while the flange sheath rests flush on the pitched roof.

3. The protective cover according to claim 2
wherein the roof vent is a structure that allows gases to flow through the pitched roof;
wherein the roof pitch refers to the angle formed between the force of gravity and the superior surface of the pitched roof.

4. The protective cover according to claim 3
wherein the vent sheath is a hollow structure;
wherein the vent sheath is formed as a tube;
wherein the vent sheath is geometrically similar to the roof vent;
wherein the span of the length of the inner diameter of the vent sheath is greater than the span of the length of the outer diameter of the roof vent such that the roof vent inserts into the vent sheath;

wherein the roof vent inserts into the vent sheath in the manner of a composite structure.

5. The protective cover according to claim 4 wherein the flange sheath is a hollow structure;

wherein the flange sheath has a pan shape;

wherein the flange sheath forms the inferior structure of the composite structure formed by the vent sheath and the flange sheath;

wherein the roof vent inserts through the pan shape of the flange sheath into the vent sheath;

wherein the center axis of the roof vent aligns with the center axes of the flange sheath and the vent sheath.

6. The protective cover according to claim 5 wherein the free congruent end is a congruent end of the vent sheath;

wherein the free congruent end is an open end of the tubular structure of the vent sheath;

wherein the free congruent end is the end of the vent sheath that is distal from the flange sheath;

wherein the free congruent end of the vent sheath allows gas to vent from the roof vent into the atmosphere;

wherein the fixed congruent end is a congruent end of the structure of the vent sheath;

wherein the fixed congruent end is an open end of the tubular structure of the vent sheath;

wherein the fixed congruent end is the congruent end of the vent sheath that is distal from the free congruent end;

wherein the fixed congruent end is the end of the vent sheath that attaches to the flange sheath to form the composite structure formed by the vent sheath and the flange sheath;

wherein the vent lateral face is the lateral face of the vent sheath;

wherein the vent lateral face forms the vertically oriented containment that encloses the roof vent;

wherein each of the plurality of set screws is a set screw;

wherein each of the plurality of set screws screws through the vent lateral face and into the roof vent to secure the composite structure formed by the vent sheath and the flange sheath to the roof vent.

7. The protective cover according to claim 6 wherein the pedestal pan physically forms the inferior structure of the composite structure formed by the vent sheath and the flange sheath;

wherein the pedestal pan forms a portion of the containment structure that encloses the roof vent.

8. The protective cover according to claim 7 wherein each of the plurality of perforations is a perforation that is formed in the flange lateral face of the pedestal pan;

wherein each of the plurality of perforations is formed to facilitate the removal of a portion of the flange lateral face of the pedestal pan during the installation of the composite structure formed by the vent sheath and the flange sheath over the roof vent.

9. The protective cover according to claim 8 wherein each of the plurality of perforations forms a helix structure on the flange lateral face of the pedestal pan;

wherein each of the plurality of perforations forms a cant relative to a plane that perpendicularly intersects the center axis of the pedestal pan;

wherein each of the plurality of perforations guides the removal of a portion of the flange lateral face of the pedestal pan such that the pedestal pan is converted into a prismatic section before the composite structure formed by the vent sheath and the flange sheath installs over the roof vent;

wherein an open congruent end of the pedestal pan forms the congruent end that is bifurcated to form the prismatic section structure of the flange sheath that is installed over the roof vent.

10. The protective cover according to claim 9 wherein the vent lateral face further comprises a plurality of set screw apertures;

wherein each of the plurality of set screw apertures is an aperture formed through the vent lateral face of the vent sheath;

wherein each of the plurality of set screw apertures is sized to receive a set screw selected from the plurality of set screws.

11. The protective cover according to claim 10 wherein the pedestal pan comprises the open congruent end, a closed congruent end, and the flange lateral face;

wherein the flange lateral face is the lateral face of the pan structure of the pedestal pan;

wherein the open congruent end is a congruent end of the pedestal pan;

wherein the open congruent end forms the congruent end of the pedestal pan that is distal from the vent sheath;

wherein the open congruent end rests on the surface of the pitched roof;

wherein the closed congruent end is the congruent end of the pan structure of the pedestal pan that forms the closed face;

wherein the closed congruent end is the congruent end of the pedestal pan that attaches to the fixed congruent end of the vent sheath to form the composite structure formed by the vent sheath and the flange sheath;

wherein the closed congruent end is formed as a funnel structure;

wherein the closed congruent end comprises a funnel structure;

wherein the funnel structure is a hollow truncated pyramid structure;

wherein the fixed congruent end of the vent sheath attaches to the open truncated apex formed by the funnel structure;

wherein the funnel structure aligns with the center axes of the composite structure formed by the vent sheath and the flange sheath.

12. The protective cover according to claim 11 wherein the plurality of perforations comprises a collection of individual perforations;

wherein each individual perforation is a perforation selected from the plurality of perforations;

wherein each individual perforation forms the helix on the flange lateral face of the pedestal pan;

wherein each individual perforation facilitates the removal of a portion of the flange lateral face of the pedestal pan to form the prismatic structure of the flange sheath.

13. The protective cover according to claim 12 wherein each individual perforation selected from the plurality of perforations is formed with an individual perforation cant;

wherein the individual perforation cant of each individual perforation forms a cant with a plane that passes perpendicularly through the center axis of the pedestal pan.

14. The protective cover according to claim 13 wherein the individual perforation cant of any first individual perforation selected from the plurality of perforations differs from the individual perforation cant of any second individual perforation selected from the plurality of perforations.

15. The protective cover according to claim 14 wherein the individual perforation cant of the individual perforation selected from the plurality of perforations to guide the removal of the flange lateral face is selected to align the open congruent end of the pedestal pan with the roof pitch such that the center axis of the composite structure formed by the vent sheath and the flange sheath will align with the force of gravity and the center axis of the roof vent.

16. The protective cover according to claim 15 wherein the vent sheath further comprises a vent seal;

wherein the vent seal is a mechanical structure that attaches to both the exterior surface of the lateral face of the roof vent and the interior surface of the vent lateral face of the vent sheath;

wherein the vent seal forms a fluid impermeable seal with the interior surface of the vent lateral face;

wherein the vent seal forms a fluid impermeable seal with the exterior surface of the lateral face of the roof vent.

* * * * *